US008021630B2

(12) United States Patent
Dassa

(10) Patent No.: US 8,021,630 B2
(45) Date of Patent: Sep. 20, 2011

(54) ANTICOAGULANT-COATED DIPSTICK FOR USE WITH A BLOOD CENTRIFUGE ROTOR

(75) Inventor: Alyssa J. Dassa, Gorham, ME (US)

(73) Assignee: IDEXX Laboratories, Inc., Westbrook, ME (US)

( * ) Notice: Subject to any disclaimer, the term of this patent is extended or adjusted under 35 U.S.C. 154(b) by 288 days.

(21) Appl. No.: 12/290,205

(22) Filed: Oct. 28, 2008

(65) Prior Publication Data

US 2009/0107903 A1 Apr. 30, 2009

Related U.S. Application Data

(60) Provisional application No. 61/000,849, filed on Oct. 29, 2007.

(51) Int. Cl.
*B04B 1/00* (2006.01)

(52) U.S. Cl. ..... 422/548; 494/16; 494/43; 210/209; 210/645; 210/789; 422/540

(58) Field of Classification Search ..... 210/206, 210/209, 645, 789; 422/99, 102, 104, 533, 422/540, 548; 494/16
See application file for complete search history.

(56) References Cited

U.S. PATENT DOCUMENTS

| | | | | |
|---|---|---|---|---|
| 4,308,232 | A | 12/1981 | Crouther et al. | 422/102 |
| 4,604,086 | A | 8/1986 | Benko et al. | 494/16 |
| 4,675,159 | A | 6/1987 | Al-Sioufi | 422/36 |
| 4,846,974 | A | 7/1989 | Kelley et al. | 210/380.1 |
| 4,981,585 | A | 1/1991 | Kelley et al. | 210/138 |
| 5,077,194 | A | 12/1991 | Heeny et al. | 435/5 |
| 5,269,443 | A | 12/1993 | Lancaster | 222/207 |
| 6,793,892 | B1 | 9/2004 | Niermann | 422/101 |
| 7,169,602 | B2 | 1/2007 | Sandell | 435/288.4 |
| 2004/0002165 | A1 | 1/2004 | Buchanan et al. | 436/180 |
| 2005/0224425 | A1* | 10/2005 | Patton et al. | 210/767 |

(Continued)

FOREIGN PATENT DOCUMENTS

| | | |
|---|---|---|
| EP | 0609794 | 8/1994 |

(Continued)

OTHER PUBLICATIONS

Baca et al. "EDTA is a Better Anticoagulant than Heparin or Citrate for Delayed Blood Processing for Plasma DNA Analysis." Clinical Chemistry 50, 1, 2004. pp. 256-257.*

(Continued)

*Primary Examiner* — Walter D Griffin
*Assistant Examiner* — Timothy Cleveland
(74) *Attorney, Agent, or Firm* — Gerald T. Bodner

(57) ABSTRACT

An anticoagulant-coated dipstick is selectively receivable by the central fill port of a rotor of a blood centrifuge. The dipstick includes an elongated, rod-like member having a first axial end and an opposite second axial end, and a cap affixed to the second axial end. At least a portion of a surface of the rod-like member is coated with an anticoagulant. The elongated rod-like member of the dipstick is dimensioned in length and diameter to be receivable through the central fill port of the rotor to contact a blood sample contained therein. The cap is circular in shape, with a diameter that is greater than that of the rotor fill port to entirely cover and seal the fill port to prevent leakage therethrough of a blood sample contained in the rotor, especially when the rotor is gently agitated or inverted.

4 Claims, 5 Drawing Sheets

U.S. PATENT DOCUMENTS

| | | | | |
|---|---|---|---|---|
| 2005/0244843 | A1 | 11/2005 | Chen et al. | 435/6 |
| 2007/0077183 | A1 | 4/2007 | Rich | 422/102 |
| 2008/0017577 | A1* | 1/2008 | Yi et al. | 210/645 |

FOREIGN PATENT DOCUMENTS

| | | |
|---|---|---|
| EP | 0766973 | 4/1997 |

OTHER PUBLICATIONS

Notification of Transmittal of the International Search Report and the Written Opinion of the International Searching Authority, or the Declaration; International Search Report; and Written Opinion of the International Searching Authority.

* cited by examiner

ANTICOAGULANT-COATED DIPSTICK FOR USE WITH A BLOOD CENTRIFUGE ROTOR

CROSS-REFERENCE TO RELATED APPLICATION

This application is based on U.S. Provisional Application Ser. No. 61/000,849, filed on Oct. 29, 2007, and entitled, "Anticoagulant-Coated Dipstick for Use with a Blood Centrifuge Rotor", the disclosure of which is incorporated herein by reference and on which priority is hereby claimed.

BACKGROUND OF THE INVENTION

1. Field of the Invention

This invention relates generally to blood separation devices, and more particularly to blood centrifuges having a spun rotor.

2. Description of the Prior Art

FIGS. 1, 1A, 2 and 3 are various views of a hematocrit rotor 2 used in a high speed spinning centrifuge used primarily for in vitro diagnostics and in conjunction with the VetTest® veterinary blood analyzer manufactured and sold by IDEXX Laboratories, Inc. of Westbrook, Me.

The rotor 2 is generally cylindrical in its overall outer shape, and includes a housing 3 having an upper portion 4 joined to a lower portion 6. The upper portion 4 and lower portion 6 define between them an interior chamber 8 or well for receiving a sample of whole blood. For this purpose, the upper portion 4 is provided with a central fill port 10 communicating with the interior chamber 8 so that a user may supply a blood sample from a pipette, syringe or the like through the port 10 and into the chamber 8 prior to centrifugation and, conversely, withdraw plasma collected in the chamber 8 after blood separation has been completed.

The rotor 2 includes a silicone gel 12 situated circumferentially about the interior chamber 8 above the lower portion 6, which gel 12 captures or absorbs the denser blood cells from the sample, but not the plasma, when the rotor 2 is spun at high speeds. After centrifugation, the plasma collects in the lower portion 6 of the rotor 2 where it may be retrieved through the port 10 in the upper portion 4 by using a pipette, syringe or the like.

In many instances, the sample of whole blood must be prevented from coagulating prior to centrifugation. It is a common practice to directly draw the blood into a collection tube, such as the Vacutainer™ tube manufactured by Becton Dickinson and Company of Franklin Lakes, N.J., that is coated on its inside surface with an anticoagulant. The anticoagulant may be one of several agents suitable for use, for example, lithium heparin. Such anticoagulants are for the most part in the form of a hygroscopic, amorphous powder, which is coated on the collection tube inside walls. The anticoagulants are soluble when contacted by the whole blood drawn into the collection tube, and mix with the blood when the tube is gently agitated or inverted.

Although the use of the direct draw collection tube, coated with an anticoagulant, works well and is suitable in most applications, there is a continuous need for blood processing products that provide the flexibility in the clinical setting.

OBJECTS AND SUMMARY OF THE INVENTION

It is an object of the present invention to provide a technique for dispensing an anticoagulant to a blood sample while the blood sample resides in a rotor of a blood centrifuge.

It is another object of the present invention to provide a device that cooperates with a blood centrifuge rotor to dispense an anticoagulant to a blood sample contained in the rotor.

It is a further object of the present invention to provide a device which cooperates with a blood centrifuge rotor that not only dispenses an anticoagulant to the blood sample contained in the rotor, but seals the rotor to prevent leakage of whole blood therefrom when the rotor is gently agitated or placed upside down.

It is yet a further object of the present invention to provide a blood centrifuge rotor and a dipstick receivable thereby, which dipstick is coated with an anticoagulant.

In accordance with one form of the present invention, a device in the form of a "dipstick" is selectively receivable through the central fill port of the rotor of a blood centrifuge, such as the high speed centrifuge rotor shown in FIGS. 1, 1A, 2 and 3. The dipstick preferably includes an elongated, rod-like member, having a first axial end and an opposite second axial end, and a cap affixed to the second axial end.

At least a portion of a surface of the rod-like member is coated with an anticoagulant. The elongated rod-like member of the dipstick is dimensioned in length and diameter to be receivable in the rotor through the central fill port. The rod-like member may be structured in various ways to expose more surface area coated with anticoagulant to the blood sample contained in the rotor. Alternatively, or in addition, the rod-like member can contain or support additional structure that carries anticoagulant reagents.

The cap of the dipstick is preferably circular in shape, with a diameter that is greater than that of the rotor fill port to entirely cover and seal the fill port in order to prevent leakage therethrough of a blood sample contained in the rotor, especially when the rotor is gently agitated or inverted to mix the anticoagulant with the whole blood contained therein, or when the rotor is stored. The cap may be provided with a circular sealing ring formed on the lower surface thereof and extending outwardly therefrom, which sealing ring is received by a cooperating circular recess formed in the upper surface of the rotor and encircling the fill port to form a liquid tight seal and to retain the cap of the dipstick to the centrifuge rotor until the cap is forcibly unseated therefrom. Alternatively, the cap may be in the form of a truncated, conical plug situated on the second axial end of the dipstick, which plug is at least partially received by, and seals, the rotor fill port.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
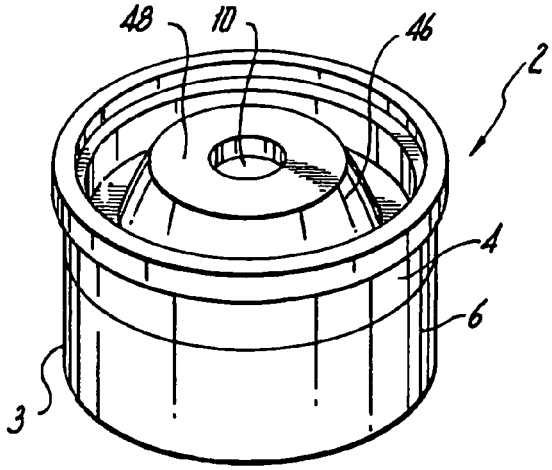
Fig. 1 (Prior Art)
FIG. 1 is perspective view of a conventional rotor for use with a high spin rate blood centrifuge.
Figure 1A:
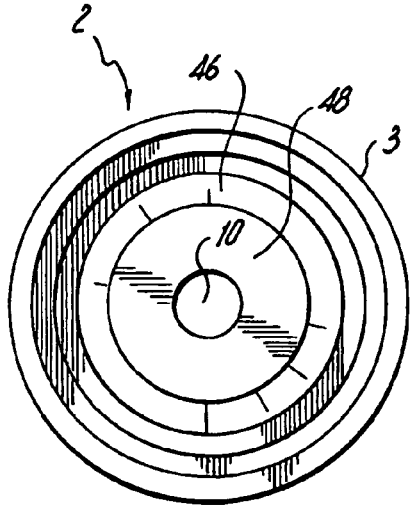
Fig. 1A (Prior Art)
FIG. 1A is a top plan view of the conventional rotor shown in FIG. 1.
Figure 2:
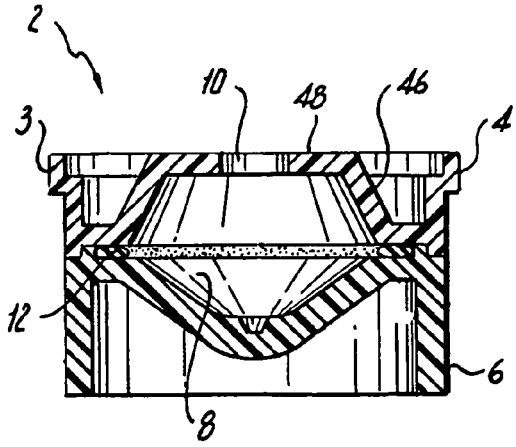
Fig. 2 (Prior Art)
FIG. 2 is a cross-sectional view of the conventional centrifuge rotor shown in FIG. 1.
Figure 3:
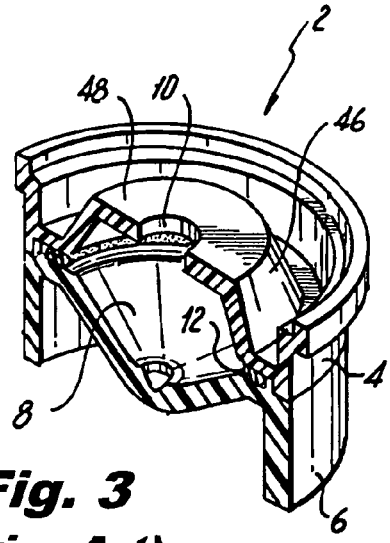
Fig. 3 (Prior Art)
FIG. 3 is a perspective view of the cross-section portion of the conventional rotor shown in FIG. 2.
Figure 4:
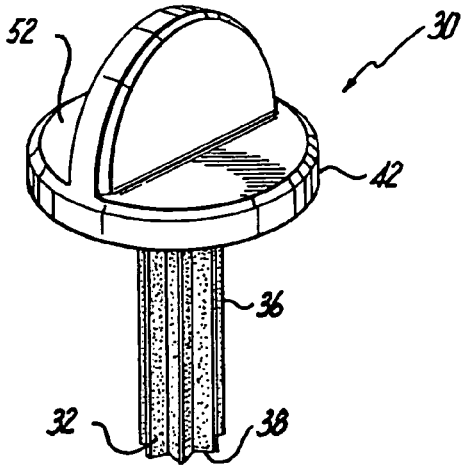
FIG. 4 is a top perspective view of an anticoagulant-coated dipstick formed in accordance with one form of the present invention.
Figure 5:
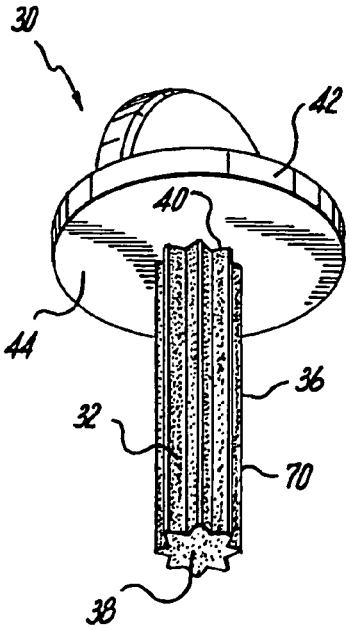
FIG. 5 is a bottom perspective view of the dipstick of the present invention shown in FIG. 4.

Initially referring to FIGS. 4 through 7 of the drawings, it will be seen that a device in the form of a "dipstick" 30 and constructed in accordance with the present invention cooperates with a rotor 2 of a blood centrifuge and in particular a high speed spinning centrifuge to dispense an anticoagulant 32 to a whole blood sample 34 contained in the rotor 2. The dipstick 30 is selectively receivable by the central fill port 10 of the rotor, such as the high speed centrifuge rotor 2 shown in FIGS. 1, 1A, 2 and 3, and repeated in FIGS. 6 and 7.

The dipstick 30 preferably includes an elongated, rod-like member 36, having a first axial end 38 and an opposite second axial end 40, and a cap 42 affixed to the second axial end 40. At least a portion of a surface of the rod-like member 36 (and/or the cap 42) is coated with an anticoagulant 32. The dipstick 30 may be coated with an anticoagulant 32 by a spray drying technique in which an aqueous solution of the anticoagulant mixed with an alcohol base is formed, and the anticoagulant solution is sprayed onto the dipstick 30. The alcohol will evaporate, leaving the anticoagulant 32 in solid form adhering to the surfaces of the dipstick 30. Alternatively, the anticoagulant 32 may be suspended in a gel-like substance that clings to the dipstick 30 and dissolves upon contact with the blood sample.

The dipstick 30 is coated with a predetermined quantity of anticoagulant 32, and the clinician will be advised of the recommended maximum volume of whole blood that should be used with the rotor 2 so that the proper ratio of anticoagulant to blood is achieved when the dipstick 30 is placed on the rotor 2 and the rotor is gently agitated.

The elongated rod-like member 36 of the dipstick is dimensioned in length and diameter to be receivable in the rotor 2 through the central fill port 10 and so that the cap 42 affixed to the opposite second axial end 40 may rest on the rotor with its lower surface 44 in close contact with the upper surface 46 of the rotor 2 to form a liquid tight seal therewith.

Figure 6:
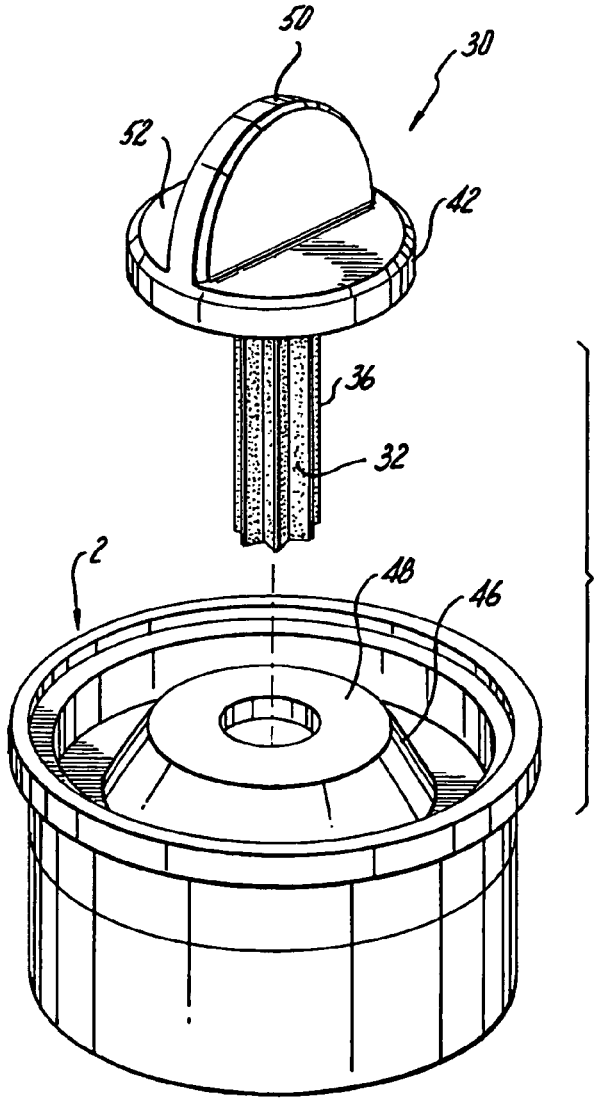
FIG. 6 is an exploded top perspective view of an anticoagulant-coated dipstick of the present invention and a blood centrifuge rotor.

The cap 42 is preferably circular in shape, although other shapes may be suitable for use, with a diameter that is greater than that of the rotor fill port 10 to entirely cover and seal the fill port to prevent leakage of a blood sample 34 contained in the rotor 2 therethrough, especially when the rotor is gently agitated or placed upside down (with the fill port 10 now on the bottom). The cap 42 of the dipstick 30 may be formed to be slightly concave to closely receive a portion of the upper surface 46 of the rotor, if the upper surface is complementary-shaped to be convex. Alternatively, the cap 42 may be planar in form to rest closely against a planar portion 48 of the upper surface of the rotor 2, as shown in FIG. 6, if the rotor is provided with such a surface.

Figure 7:
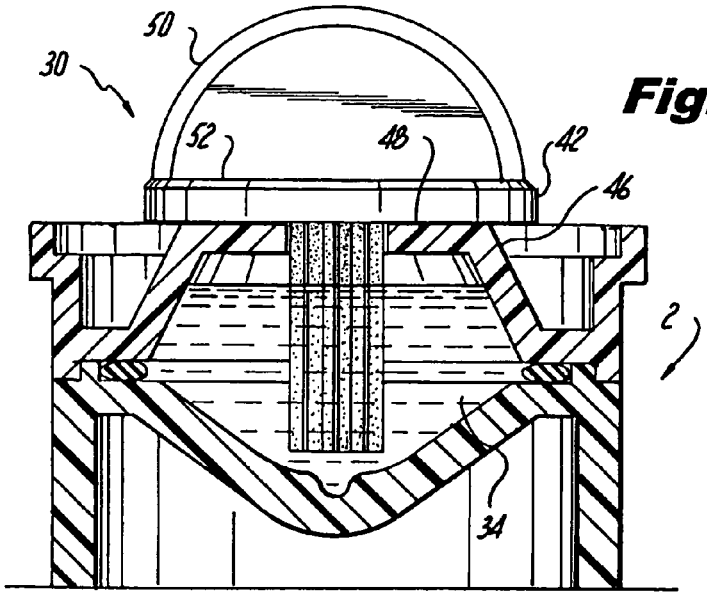
FIG. 7 is a cross-sectional view of the blood centrifuge rotor and dipstick of the present invention shown in FIG. 6, with the dipstick illustrated as being received by the rotor.

FIG. 7 illustrates the anticoagulant-coated dipstick 30 of the present invention seated on the blood centrifuge rotor 2, with the blood sample 34 contained in the rotor being in contact with the elongated rod-like member 36 of the dipstick. The anticoagulant coating 32 on the dipstick 30 dissolves when contacted by the whole blood 34 contained in the rotor 2, and mixes with the blood when the rotor is gently agitated or inverted. Also, as shown in FIGS. 6-8, the dipstick 30 may include a tab 50 protruding from the upper surface 52 of the cap 42, which acts as a handle for the clinician to grasp when positioning the dipstick 30 on the rotor 2 or removing the dipstick therefrom.

Figure 8:
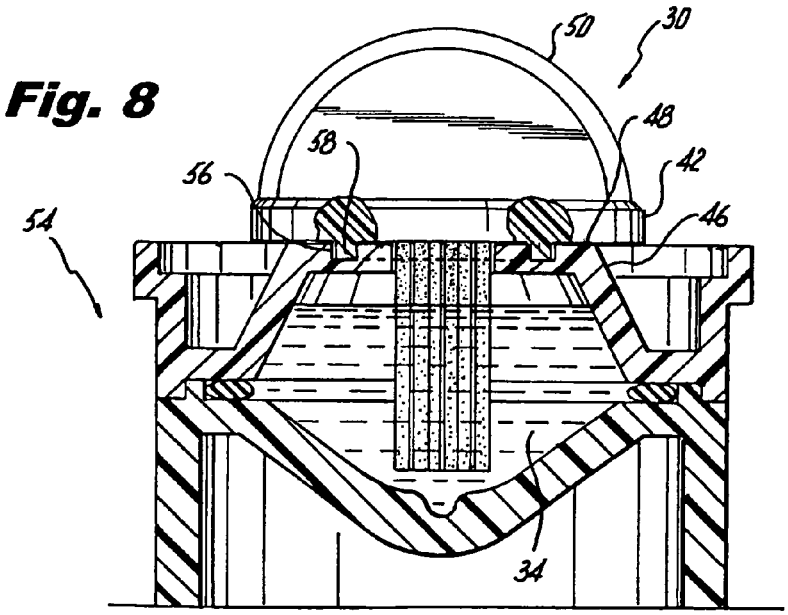
FIG. 8 is a cross-sectional view of a blood centrifuge rotor and anticoagulant-coated dipstick of the present invention, with each component having cooperating structure for selectively retaining the dipstick to the rotor.

FIG. 8 shows an alternative form of the anticoagulant-coated dipstick 30 of the present invention, as well as a rotor 54 for a blood centrifuge that includes structure for cooperating with the dipstick. Here, the rotor 54, which may have the structure shown in FIGS. 1, 1A, 2 and 3, may further include a circular recess 56 formed in its upper surface 46 surrounding the fill port 10. A similarly dimensioned circular sealing ring 58 or protrusion formed on the lower surface 44 of the dipstick cap 42 and extending outwardly from the lower surface is received by the recess 56 formed in the rotor 54 when the dipstick 30 is mounted on the rotor. The cap sealing ring 58 and recess 56 on the rotor surface cooperate by an interference fit to ensure that the cap 42 is retained on the rotor 54 to form a liquid tight seal therewith until the dipstick 30 is forcibly removed from the rotor by the clinician. It is envisioned, of course, that the rotor 54 and anticoagulant-coated dipstick 30 may have other interlocking structure to selectively retain the dipstick on the rotor and ensure that a liquid tight seal is created between the two components, and that the position of the recess 56 and ring 58 may be reversed, with the recess 56 being formed in the lower surface 44 of the cap, and the sealing ring 58 being formed on the upper surface 46 of the rotor and surrounding the fill port 10.

The elongated rod-like member 36 of the dipstick 30 may take on various forms that increase the surface area, coated with the anticoagulant 32, that is exposed to the blood sample 34 contained in the rotor 2. Such various structures include, but are not limited to, those shown in FIGS. 9 through 15.

Figure 9:
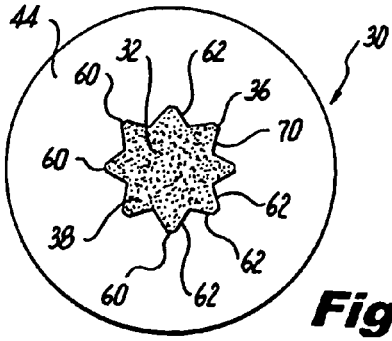
FIG. 9 is a bottom plan view of the anticoagulant-coated dipstick of the present invention shown in FIGS. 4 and 5.

More specifically, the elongated rod-like member 36 of the dipstick 30 may have a star-shaped transverse cross-section, as shown in FIG. 9, with radially extending triangular protrusions 60, which include sides 62 that are exposed to contact the blood sample 34 in the rotor. The entire exposed outer surface 70 of the elongated rod-like member 36, including the sides 62 of the triangular protrusions 60, or at least a portion thereof, is coated with an anticoagulant 32. The structure of the dipstick 30 shown in FIG. 9 is also shown in FIGS. 4 through 8.

Figure 10:
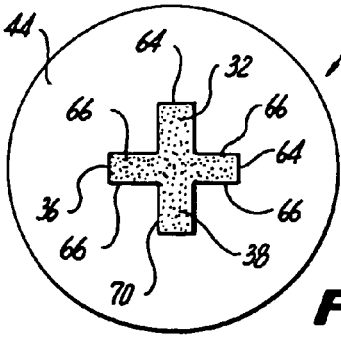
FIG. 10 is a bottom plan view of an alternative embodiment of an anticoagulant-coated dipstick formed in accordance with the present invention.

Alternatively, and as shown in FIG. 10, the elongated rod-like member 36 may have a criss-cross transverse cross-section defined by a plurality of rectangular protrusions 64 extending diametrically opposite one another from the outer surface 70 of the member 36 so that each side 66 of the rectangular protrusions 64, again coated with an anticoagulant 32, is exposed to and comes in contact with the blood sample 34 contained in the rotor 2.

Figure 11:
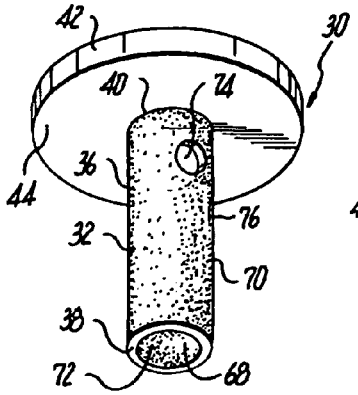
FIG. 11 is a bottom perspective view of an alternative embodiment of an anticoagulant-coated dipstick of the present invention for use with a blood centrifuge rotor.
Figure 12:
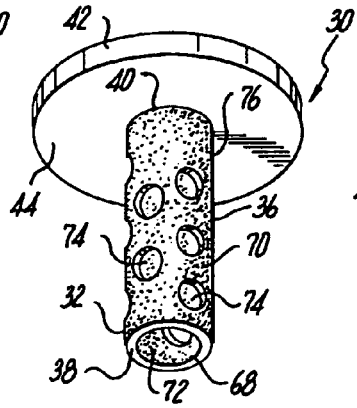
FIG. 12 is a bottom perspective view of an alternative embodiment of an anticoagulant-coated dipstick of the present invention for use with a blood centrifuge rotor.

Two other possible configurations for the dipstick 30 of the present invention are shown in FIGS. 11 and 12. Here, the elongated rod-like member 36 is cylindrical in form to define a central bore 68 running axially along its longitudinal length. Such structure will expose the outer surface 70, as well as the inner surface 72, of the elongated rod-like member 36 to the blood sample 34. Both the outer surface 70 and the inner surface 72 of the cylindrical member are coated with an anticoagulant 32. One or more holes 74 may be formed radially in the side wall 76 of the cylindrical member extending from the outer surface 70 to the inner surface 72 to ensure that the blood sample 34 will come in contact with the inner surface 72 and the anticoagulant 32 coated thereon, and to allow any air trapped within the bore 68 to escape therethrough.

Figure 13:
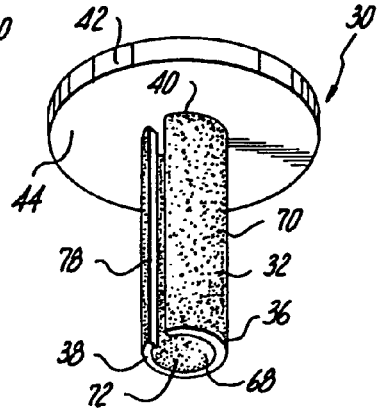
FIG. 13 is a bottom perspective view of an alternative embodiment of an anticoagulant-coated dipstick of the present invention for use with a blood centrifuge rotor.

Another alternative form of the dipstick 30 of the present invention is shown in FIG. 13. Here, the elongated rod-like member 36 is, again, cylindrical in form to define an axial bore 68 extending along the longitudinal length thereof, to expose not only the outer surface 70 but also the inner surface 72 of the cylindrical member, each being coated with anticoagulant 32, to the blood sample 34 contained in the rotor 2. The side wall 76 of the cylindrical member may be formed with a slot 78 extending axially along its length and through the thickness thereof to ensure that the blood sample 34 flows into the axial bore 68 of the member to contact the inner surface 72 thereof and to allow any air within the bore to escape therethrough.

Figure 14:
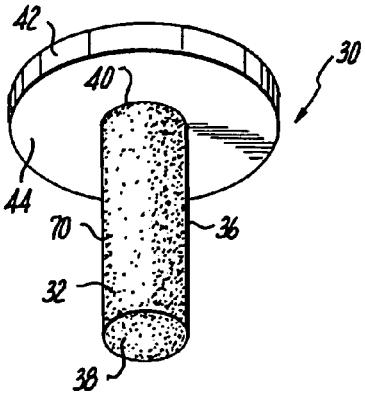
FIG. 14 is a bottom perspective view of an alternative embodiment of an anticoagulant-coated dipstick of the present invention for use with a blood centrifuge rotor.

Of course, it is envisioned that the dipstick 30 of the present invention may include an elongated, rod-like member 36 which is solid to expose the outer surface 70 of the member and the first axial end 38 thereof, each being preferably coated with anticoagulant 32, to the blood sample 34 contained in the rotor 2, as shown in FIG. 14.

Figure 15:
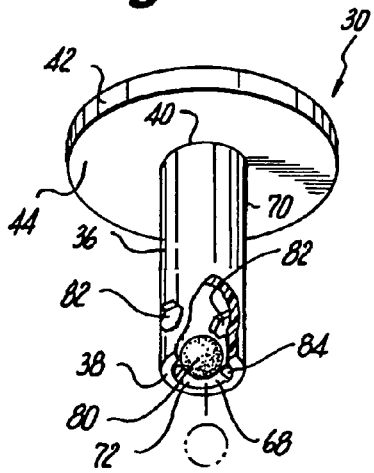
FIG. 15 is a bottom perspective view of an alternative embodiment of an anticoagulant-coated dipstick of the present invention for use with a blood centrifuge rotor.

FIG. 15 shows yet another form of the dipstick 30 of the present invention. In this embodiment, the elongated, rod-like member 36 is a cylinder formed with an axially extending bore 68 in which is captively held a sphere or bead 80 coated with an anticoagulant 32. Two diametrically opposed openings 82 having diameters which are less than that of the anticoagulant bead 80 are formed in the side wall 76 of the member and extend therethrough from the outer surface 70 thereof to the inner surface 72 to allow the blood sample 34 contained in the rotor 2 to come in contact with the anticoagulant bead 80 through the openings 82 and through the open first axial end 38 of the member. The anticoagulant bead 80 may be forcibly received through the open first axial end 38 of the dipstick. Angled prongs or tabs 84 extending interiorly of the bore 68 near the first axial end 38, or other structure, such as a pin (not shown) extending diametrically across the bore 68, prevent the anticoagulant bead 80 from falling out of the first axial end 38 of the dipstick. The anticoagulant coating 32 on the bead 80 dissolves into the blood sample 34, and the spent bead is removed with the dipstick 30 prior to centrifugation. The advantage of this "bead holder" design for the dipstick 30 is that the bead 80 is always retained by the dipstick and can never become dislodged therefrom where it may have otherwise interfered with centrifugation of the blood sample 34 and the removal of the separated plasma from the well 8 of the rotor 2. Alternatively, this particular embodiment of the "bead holder" dipstick 30 may be used to retain a compressed powder pellet of anticoagulant in place until the entire pellet has dissolved in the blood sample 34.

Figure 16:
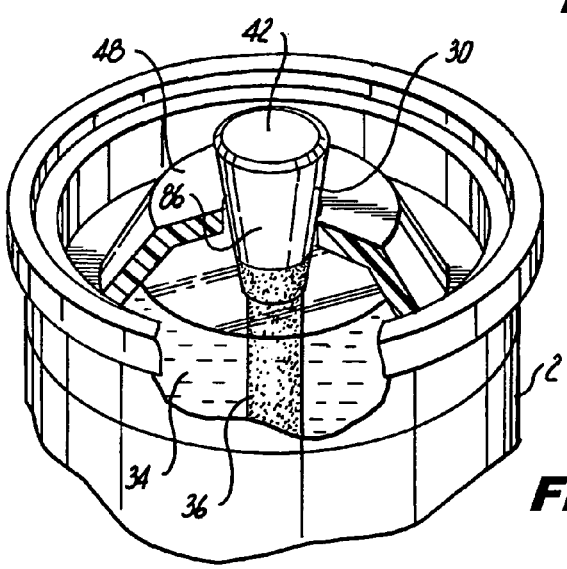
FIG. 16 is a top perspective view of an alternative embodiment of an anticoagulant-coated dipstick of the present invention, and illustrating its placement on a blood centrifuge rotor.

In a further alternative embodiment of the invention, as shown in FIG. 16, the cap 42 of the dipstick 30 may be formed as a truncated conical plug 86 that is at least partially received by the fill port 10 of the rotor 2 to create a liquid tight seal with the fill port.

The dipstick 30 is coated with an anticoagulant 32, such as lithium heparin, although other anticoagulants are suitable for use, including but not limited to sodium heparin, EDTA (ethylenediaminetetraacetic acid), citrate and ammonia heparin. The aforementioned anticoagulants are hygoscopic, amorphous powders that coat the surface of the dipstick 30 of the present invention as described previously. The anticoagulant 32 may coat all or a portion of the elongated, rod-like member 36, and also, if desired, the lower surface 44 of the cap 42 which contacts the upper surface 46 of the rotor 2.

A predetermined volume of whole blood sample 34, without anticoagulant, is deposited into the rotor 2 through the fill port 10. Then, the anticoagulant-coated dipstick 30 of the present invention is placed on the rotor 2, with the elongated, rod-like member 36 being received by the fill port 10 and extending into the interior cavity 8 of the rotor. The whole blood sample 34 contained in the rotor 2 contacts the dipstick 30, and the anticoagulant coating 32 thereon dissolves and mixes with the blood sample upon a gentle agitation of the rotor. The cap 42 of the dipstick 30 closely contacts the rotor 2 to form a liquid tight seal therewith to prevent the blood sample 34 from leaking through the fill port 10 when the rotor is gently agitated or placed upside down, with the fill port now on the bottom.

Figure 17:
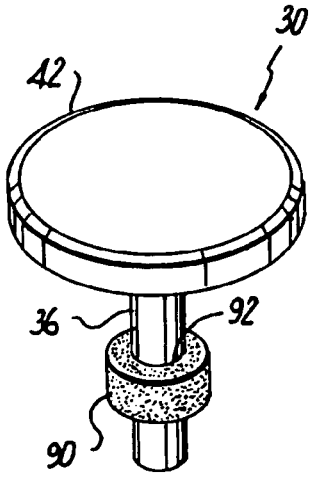
FIG. 17 is a top perspective view of an alternative embodiment of a dipstick of the present invention for use with a blood centrifuge rotor, the dipstick including an anticoagulant "donut".
Figure 18:
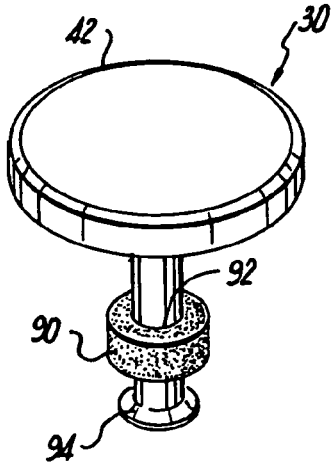
FIG. 18 is a top perspective view of the embodiment of the anticoagulant-coated dipstick of the present invention shown in FIG. 17, after the tip of the dipstick is heat staked to form a flange.
Figure 19:
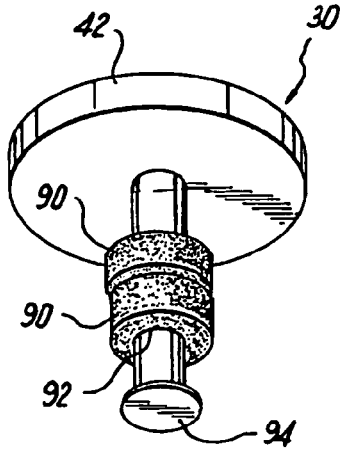
FIG. 19 is bottom perspective view of the embodiment of the anticoagulant-coated dipstick of the present invention shown in FIG. 18, but with a plurality of anticoagulant donuts mounted thereon.

Another form of a centrifuge rotor dipstick 30 is shown in FIGS. 17-19. Here, the dipstick 30 includes an elongated rod-like member 36 which may or may not be coated with an anticoagulant, a cap 42 affixed to one axial end of the rod-like member 36, and one or more "donuts" 90 coated or formed with an anticoagulant mounted on the rod-like member 36 of the dipstick 30. The anticoagulant donut 90 is basically toroidal in shape, it includes a central opening 92 through which is received the rod-like member 36 when the anticoagulant donut is mounted thereon. Preferably, the outer surface of the donut 90 is coated with an anticoagulant to which the blood sample is exposed when the dipstick 30, with the donut 90 mounted thereon, is placed in the rotor 2 through the central fill port 10. The outer diameter of the donut 90 is less than the diameter of the rotor port 10 so that the elongated rod-like member 36 of the dipstick, and the donut 90 mounted thereon, may pass therethrough into the chamber 8 of the rotor 2 to come in contact with a blood sample contained therein. As in the previously described embodiments of the present invention, the cap 42 of this embodiment preferably forms a seal with the central fill port 10 of the rotor 2.

As stated previously, the donut 90 contains, or is coated with, a certain quantity of blood anticoagulant. However, a user may select a desired quantity of anticoagulant to which the blood sample in the rotor 2 is exposed by using a dipstick 30 having a certain number of anticoagulant donuts 90 mounted in a stacked arrangement on the rod-like member 36 thereof, as shown in FIG. 19.

In constructing the dipstick 30 of the present invention, one or more anticoagulant donuts 90 are mounted on the elongated rod-like member 36. Then, the free axial end of the rod-like member is heat staked to form a flange 94 having a diameter which is greater than that of the donut opening 92 so that the donuts 90 are captively held on the rod-like member 36 of the dipstick 30 and cannot fall off, as illustrated by FIGS. 18 and 19. Of course, it is envisioned to be within the scope of the present invention to employ structure on the free end of the dipstick 30, such as a diametrically extending pin (not shown), other than the flange 94 to retain the anticoagulant donut 90 on the rod-like member 36 of the dipstick 30.

Although a torroidally-shaped anticoagulant "donut" 90 is described herein in detail and shown in FIGS. 17-19, such a shape is by way of example only to facilitate an understanding of this embodiment of the present invention, it should be realized that other anticoagulant members, such as in the form of holed disks or plate-like members, either circumferentially curved or polygonal in shape, mounted on the elongated member 36 of the dipstick 30, are envisioned to be within the scope of the present invention.

Accordingly, an advantage of the present invention is that the clinician may use the rotor 2 for centrifuging blood samples with or without anticoagulant. With the present invention, the clinician is now given the option of using the anticoagulant-coated dipstick 30 of the present invention with the blood sample 34 in the rotor, or centrifuging the blood sample in the rotor without an anticoagulant, and the structure of the rotor 2 need not change for either situation. Furthermore, with the present invention, no collection tube need be used. The blood sample may be drawn with a syringe and immediately transferred to the rotor 2. The anticoagulant-coated dipstick 30 is then placed on the rotor 2, and the rotor is gently agitated or inverted to mix the blood and anticoagulant 32 dispensed by the dipstick 30. The anti-coagulated blood sample may now be stored in the rotor 2, sealed by the cap 42 of the dipstick, until it is desired to centrifuge the sample. At that point, the dipstick 30 may be removed from the rotor 2, and the sample is ready to be centrifuged.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A dipstick for use with a rotor of a blood centrifuge, the rotor having a fill port formed through a surface thereof, the dipstick comprising:

an elongated member having a first axial end and a second axial end situated opposite the first axial end, and a cap situated on the second axial end; and an anticoagulant member, the anticoagulant member having a thickness and further having a central opening formed axially through the thickness thereof, the elongated member of the dipstick being received by the central opening of the anticoagulant member, the anticoagulant member being captively mounted on the elongated member, the elongated member and the anticoagulant member being receivable by the fill port of the rotor when the dipstick is mounted thereon.

2. A dipstick as defined by claim 1, wherein the anticoagulant member is generally torroidal in shape.

3. A dipstick as defined by claim 1, wherein the first axial end of the elongated member includes a flange extending radially outwardly therefrom, the flange being provided to retain the anticoagulant member on the elongated member.

4. In combination:

a rotor for a blood centrifuge, the rotor including a housing defining a chamber interiorly thereof for receiving a whole blood sample, the housing including an upper portion, the upper portion having a port formed through the thickness thereof, the port being in fluid communication with the chamber; and a dipstick mountable on the blood centrifuge rotor, the dipstick including an elongated member having a first axial end and a second axial end situated opposite the first axial end, a cap situated on the second axial end of the elongated member, and an anticoagulant member, the elongated member of the dipstick being receivable by the fill port of the blood centrifuge rotor and extending into the chamber thereof, the cap of the dipstick being disposed in close proximity to the upper portion of the blood centrifuge rotor when the elongated member of the dipstick is received by the fill port of the blood centrifuge rotor, the anticoagulant member having a thickness and further having a central opening formed axially through the thickness thereof, the elongated member of the dipstick being received by the central opening of the anticoagulant member, the anticoagulant member being mounted on the elongated member with the elongated member passing through the central opening of the anticoagulant member, the anticoagulant member being disposed within the chamber of the blood centrifuge rotor when the dipstick is mounted on the blood centrifuge rotor.

* * * * *